US011913642B2

(12) United States Patent
Morton et al.

(10) Patent No.: US 11,913,642 B2
(45) Date of Patent: Feb. 27, 2024

(54) APPARATUS, METHODS, AND SYSTEMS FOR PROVIDING A MODULAR TUBULAR EXHAUST

(71) Applicant: E2COMPLY, LLC, Bonita Springs, FL (US)

(72) Inventors: Benjamin Morton, Peoria, IL (US); Dave Peterson, Peoria, IL (US); Keith Gerks, Rock Island, IL (US)

( * ) Notice: Subject to any disclaimer, the term of this patent is extended or adjusted under 35 U.S.C. 154(b) by 848 days.

(21) Appl. No.: 16/941,767

(22) Filed: Jul. 29, 2020

(65) Prior Publication Data

US 2022/0034507 A1 Feb. 3, 2022

(51) Int. Cl.
*F23J 13/02* (2006.01)
*F23J 13/04* (2006.01)

(52) U.S. Cl.
CPC ..... *F23J 13/025* (2013.01); *F23J 13/04* (2013.01); *F23J 2213/202* (2013.01)

(58) Field of Classification Search
CPC ..... F23J 13/025; F23J 13/04; F23J 2213/202; F16L 25/10; F16L 27/12; F16L 27/127; F16L 27/1273; F16L 27/1275; F16L 27/12751
See application file for complete search history.

(56) References Cited

U.S. PATENT DOCUMENTS

| | | | | |
|---|---|---|---|---|
| 281,710 | A * | 7/1883 | McGuire | F23J 13/04 |
| 1,111,384 | A * | 9/1914 | T. M. | F23J 13/025 |
| 2,372,707 | A * | 4/1945 | Blome | E04F 17/02 |
| 4,719,752 | A * | 1/1988 | Hall | F16L 27/12751 |
| 6,113,155 | A * | 9/2000 | Beirens | F23J 13/04 |
| 6,811,190 | B1 * | 11/2004 | Ray | F23J 13/04 |
| 8,918,225 | B2 | 12/2014 | Lazaris | |
| 9,555,753 | B2 | 1/2017 | James | |
| 10,439,429 | B2 | 10/2019 | Ristau | |
| 2002/0182552 | A1 * | 12/2002 | Nielsen | F23J 11/04 |
| 2006/0087121 | A1 * | 4/2006 | Bradley | F16L 21/08 |
| 2009/0008998 | A1 | 1/2009 | Behrentdorff et al. | |
| 2012/0150679 | A1 | 6/2012 | Lazaris | |

(Continued)

FOREIGN PATENT DOCUMENTS

| | | | | |
|---|---|---|---|---|
| EP | 3156726 | A1 * | 4/2017 | F23J 13/04 |
| EP | 3156727 | A1 * | 4/2017 | F23J 13/04 |
| GB | 2220055 | A * | 12/1989 | F23J 13/02 |

*Primary Examiner* — Zachary T Dragicevich
(74) *Attorney, Agent, or Firm* — Derek Fahey, Esq.; The Plus IP Firm, PLLC

(57) ABSTRACT

The modular tubular exhaust system includes a first tubular body, a second tubular body and at least one third tubular body connecting to form, a fully assembled configuration, a vertically arranged exhaust pipe. The first, the second, and the third tubular bodies each have a tubular body first end and a tubular body second end where the first ends and second ends are configured to mate with each other to form the vertically arranged exhaust pipe. The system further includes tabs that extend radially outward on opposing sides of the tubular bodies to allow a plurality of fasteners to attach tubular bodies together when arranged in the vertical configuration. The assembled configuration may vary within the spirit and scope of the disclosure, for example, in some embodiments, the system may only have a first and a second tubular section or a first, second, and a plurality of third tubular sections.

19 Claims, 13 Drawing Sheets

(56) References Cited

U.S. PATENT DOCUMENTS

| | | | |
|---|---|---|---|
| 2013/0218355 | A1 | 8/2013 | Lazaris |
| 2014/0351010 | A1 | 11/2014 | Kong |
| 2015/0130277 | A1 | 5/2015 | Ballantine et al. |
| 2015/0370225 | A1 | 12/2015 | McCune et al. |
| 2016/0294188 | A1 | 10/2016 | Stiefenhofer |
| 2017/0133879 | A1 | 5/2017 | Eckhardt et al. |
| 2017/0201077 | A1 | 7/2017 | Hafner et al. |
| 2017/0331325 | A1 | 11/2017 | Ristau |
| 2019/0058352 | A1 | 2/2019 | Gow et al. |
| 2019/0146537 | A1 | 5/2019 | Forbes, Jr. |
| 2019/0207376 | A1 | 7/2019 | Weon et al. |
| 2019/0245476 | A1 | 8/2019 | Janik |
| 2020/0036224 | A1 | 1/2020 | Forbes, Jr. |

* cited by examiner

100

APPARATUS, METHODS, AND SYSTEMS FOR PROVIDING A MODULAR TUBULAR EXHAUST

CROSS-REFERENCE TO RELATED APPLICATIONS

Not Applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present disclosure relates to the field of exhaust systems, and more specifically to the field of exhaust systems for commercial and industrial purposes.

BACKGROUND

Exhaust systems direct the flow of gasses away from the motorized system though exhaust pipes to prevent recirculation. Additionally, generator systems and other machines or apparatus that exhaust gasses may be placed in areas where sound attenuation and gas emissions are a concern. Currently, the most efficient systems to address the problems associated with generation and exhaust systems are vertical exhaust stacks. A vertical stack is vertical pipe attached to the machine or apparatus emitting gasses or exhaust. The vertical stacks allow gasses to naturally rise and it allows the gasses to safely evacuate the system and vent into the atmosphere; however, the dimensions of the exhaust systems usually need to be adjusted to satisfy environmental regulations, local codes, public ordinances, and safety standards.

The variation among vertical stacking systems leads to increased costs. Currently, long sections of piping and tubing are constructed to make a vertical stack exhaust. Typically, the length of the vertical stack piping varies tremendously based on the needs of the usage and the active regulations and standards. The costs associated with the variation in stack length is attributed to the fabrication of making the different length piping and the amount of materials used as pipe increase in size. As the pipes increase in size, the piping is difficult to ship to the consumer. Often times, the vertical stack systems need to be strapped down and transported on flatbed industrial trucks further increasing the costs associated with shipping and handling. Additionally, labor and installation costs are increased because the larger the vertical stack is manufactured, the more difficult and time consuming it is to install and to transport.

Furthermore, when the vertical exhaust stacks expel the gasses into the atmosphere, the top opening of the stack is exposed to the elements of nature, namely rain. To prevent water exposure, exhaust caps are connectedly attached to the stack exhaust opening where the gasses are released. The caps open when there is a pressure buildup of exhaust to expel the gasses; however, these caps can degrade the horsepower and performance of the motor or generator.

As a result, there exists a need for improvements over the prior art and, more particularly, a more efficient exhaust stack system.

SUMMARY

A modular tubular exhaust system is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a modular tubular exhaust system is disclosed. The system includes a first tubular body, a second tubular body and at least one third tubular body connecting to form, in a fully assembled configuration, a vertically arranged exhaust pipe. The first tubular body has a first tubular body first end and a first tubular body second end. The second tubular body has a second tubular body first end and a second tubular body second end. At least one third tubular body having a third tubular body first end and a third tubular body second end. The first ends and second ends are configured to mate with each other to form the vertically arranged exhaust pipe. Additionally, a pair of first tabs extends radially outward from the first tubular body second end and third tubular body second end, where each first tab has a first hole and where the first tabs are on opposing sides of the first tubular body and each third tubular body. A pair of second tabs extends radially outward from the third tubular body first end and the second tubular body first end, where each second tab has a second hole and where the second tabs are on opposing sides of third tubular body and second tubular body. Furthermore, the system includes a plurality of fasteners, where each fastener attaches one first tab with one second tab on a same side of adjacent tubular bodies when the vertically arranged exhaust pipe is in the fully assembled configuration. In one embodiment, the system may include only a first tubular body and a second tubular body. In another embodiment, the system may include first tubular body, a second tubular body, and a plurality of third tubular bodies. Furthermore, it is understood that in some embodiments, the third tubular body and the second tubular body may be the same.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the disclosure and together with the description, serve to explain the principles of the disclosed embodiments. The embodiments illustrated herein are presently preferred, it being understood, however, that the disclosure is not limited to the precise arrangements and instrumentalities shown, wherein.

DETAILED DESCRIPTION

Figure 1:
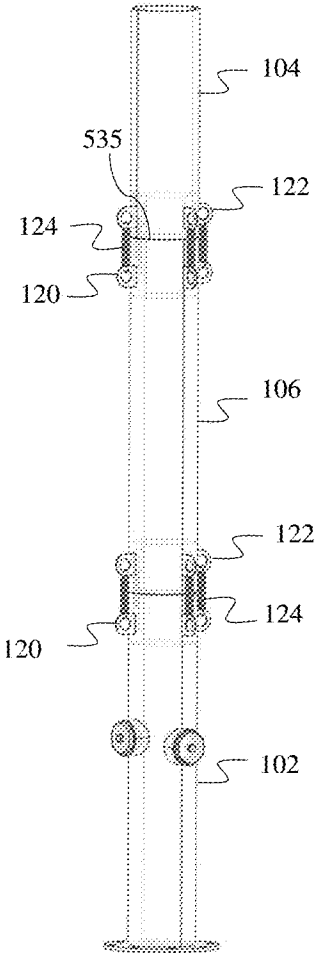
FIG. 1 is a perspective view of the system in the assembled configuration, according to one embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting, reordering, or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the problems with the prior art by providing a modular tubular exhaust system. Unlike the prior art, the modular tubular exhaust system includes, in one embodiment, a first tubular body, a second tubular body and at least one third tubular body connecting to form, in a fully assembled configuration, a vertically arranged exhaust pipe. The modular tubular system allows for variations in assembled configurations based upon the needs of the environment. In some embodiments, the system may include third tubular bodies to increase the height of the system. This improves over the prior art by providing a better and more cost-effective way to change the length of exhaust systems very simply easily. In other embodiments, the third tubular section may be synonymous with the second tubular section. Each tubular body has a first tubular end and a second tubular end. The first ends and second ends mate with each other to form the vertically arranged exhaust pipe. One of the improvements over the prior art, is the fact that the sections of the tubular pipes are configured to fit very easily into each other. This allows for the variation in assembled configurations within the spirit and scope of the disclosure. Additionally, the tubular bodies have a pair of first tabs extending radially outward to allow a plurality of fasteners to connect two tubular bodies together. Because the modular tubular system allows for variation in vertical dimensions, guy wires may be attached to the tabs and to a surface to support the exhaust stack. The tabs allow the user to easily attach the sections of tubular bodies together and also fact is a simple means for attaching guy wires to the tubular bodies. The system improves over the prior art by greatly reducing the amount of time energy and cost for transportation, assembly, disassembly, reassembling etc. However, other improvements not specifically mentioned may also be associated with the present disclosure.

Figure 1A:
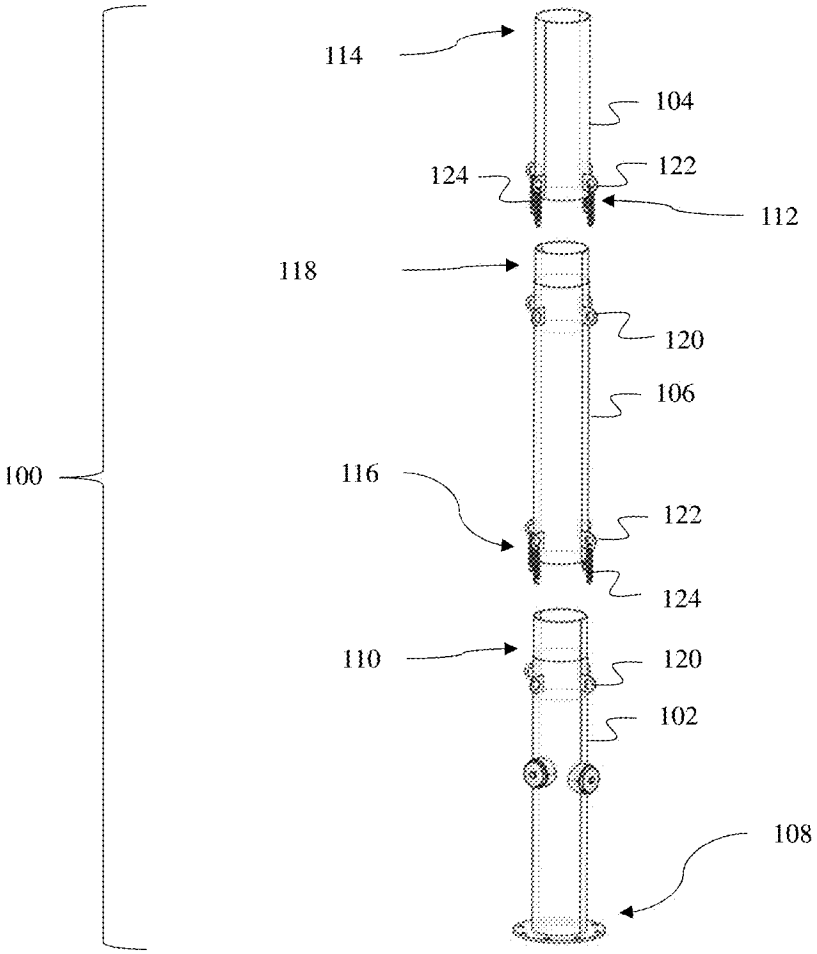
FIG. 1A is an exploded perspective view of the system, according to one embodiment.

Referring now to FIG. 1 and FIG. 1A, an apparatus and system for providing a modular tubular exhaust 100 is depicted. The system includes a first tubular body 102, a second tubular body 104, and at least one third tubular body 106 connecting to form in a fully assembled configuration, a vertically arranged exhaust pipe system 100. The first tubular body includes a first tubular body first end 108 and a first tubular body second end 110. The first tubular body is further detailed in FIG. 5A. The second tubular body includes a second tubular body first end 112 and a second tubular body second end 114. The second tubular body is further detailed in FIG. 5B. The third tubular body includes a third tubular body first end 116 and a third tubular body second end 118. The third tubular body is further detailed in FIG. 5C. The first ends and second ends are configured to mate with each other to form the vertically arranged exhaust pipe. The system includes a pair of first tabs 120 extending radially outward from the first tubular body second end and third tubular body second end, where each first tab has a first hole 410 and where the first tabs are on opposite sides of the first tubular body and each third tubular body. The system also includes a pair of second tabs 122 extending radially outward from the third tubular body first end and the second tubular body first end, each second tab has a second hole 415 and where the second tabs are on opposite sides of the third tubular body and second body. The system further includes a plurality of fasteners 124, where each fastener attaches one first tab with one second tab on a same side of adjacent tubular bodies when the vertically arranged exhaust pipe is in the fully assembled configuration. The first tubular body, second tubular body, and third tubular body may include materials such as steel, fiberglass, stainless steel, metal, copper, titanium, aluminum, alloy, nickel, chromium, and other materials.

Figure 2:
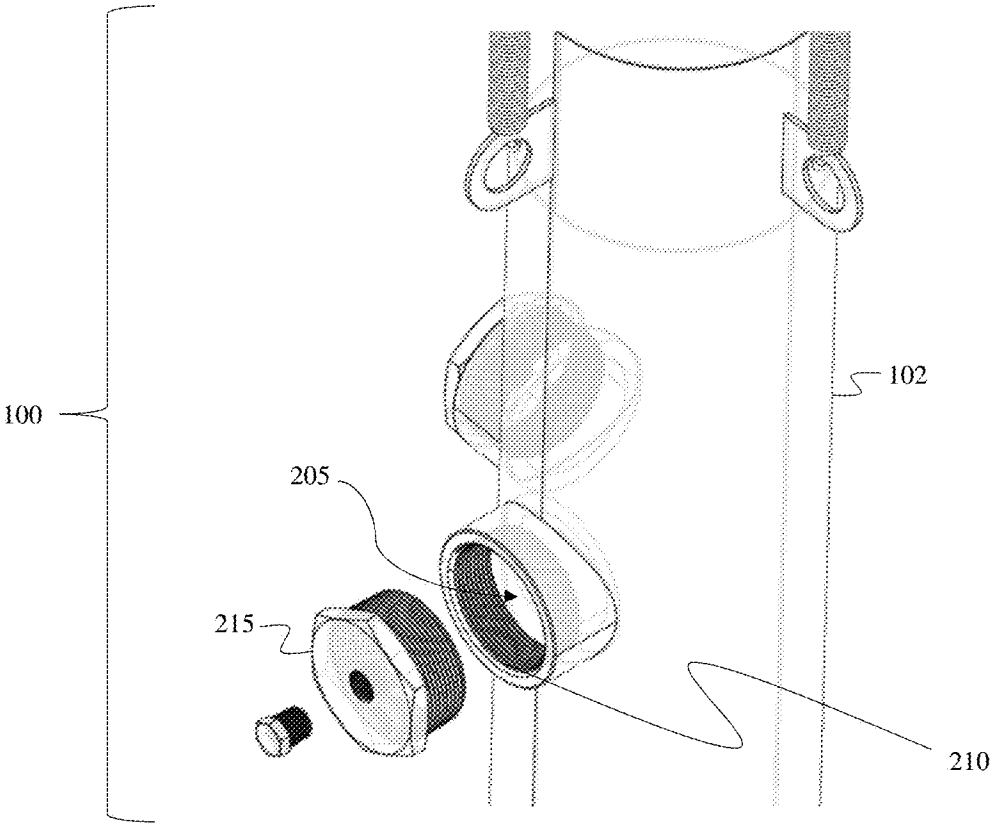
FIG. 2 is a partially exploded perspective view of the components of the system illustrating the emission opening, threaded emission opening wall, and the threaded plug, according to one embodiment.
Figure 5A:
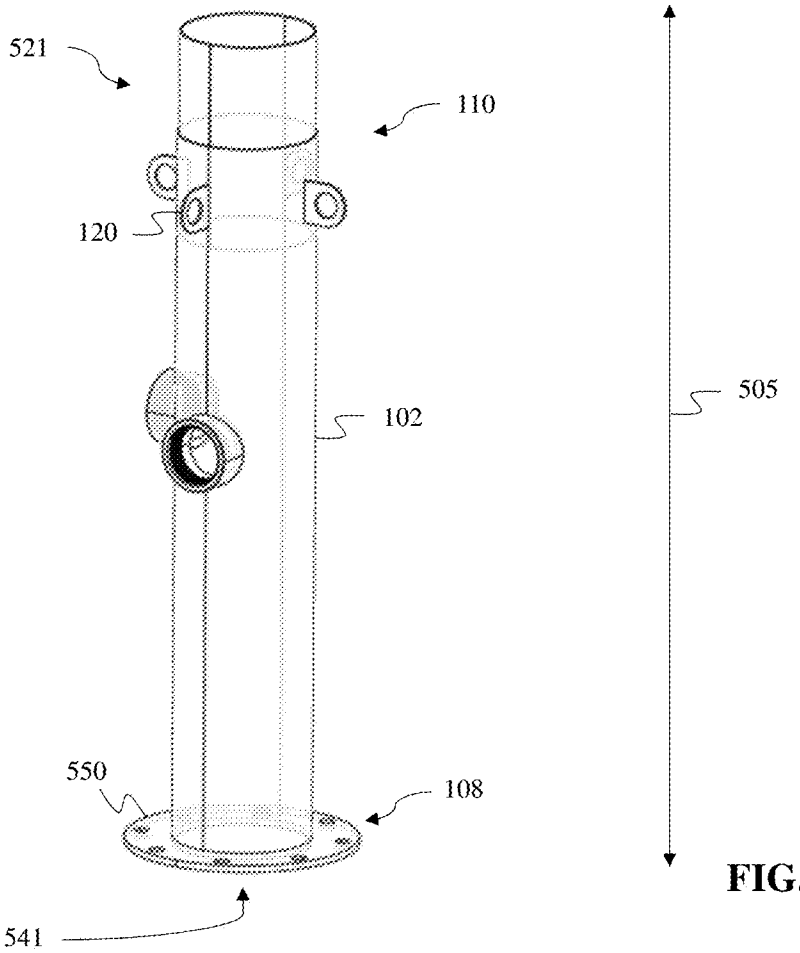
FIG. 5A is a detailed perspective view of a first tubular section, according to one embodiment.

Referring to FIG. 2, illustrated is a detailed, partially exploded perspective view of the system, according to one embodiment. The system includes an emission opening 205 providing access to inside the exhaust pipe so that a sample of emissions flowing from the system may be collected. Referring to FIG. 2, the emission opening is depicted on the first tubular body 102, according to an example embodiment. It is understood that the system may include an emission opening on at least one of the first tubular body, second tubular body, and third tubular body. The emission opening is defined by a threaded emission opening wall 210 and where a threaded plug 215 is removably attached to the threaded emission opening wall. The treads on the opening wall 210 are configured to mate with the treads on the treaded plug 215. FIG. 5A depicts a first tubular body including two emission openings, in one embodiment. The second emission opening can be seen on the backside of the image depicted in light black lines to illustrate the three-dimensional tubular body where the threaded plug is removably attached to the inside of the threaded wall opening. The threaded plug threadedly engages the threaded emission opening wall where the threaded plug and the threaded wall may create a seal to prevent the emissions from escaping through the emission opening when the plug is attached to the system. Because the plug is removably attached to the system, the plug can be threadedly engaged to allow access to the inside of a tubular body. Sample emissions and testing can be conducted through the emission opening. When the plug is removed from the emission opening, emission gasses will be able to escape through the emission opening.

Figure 3:
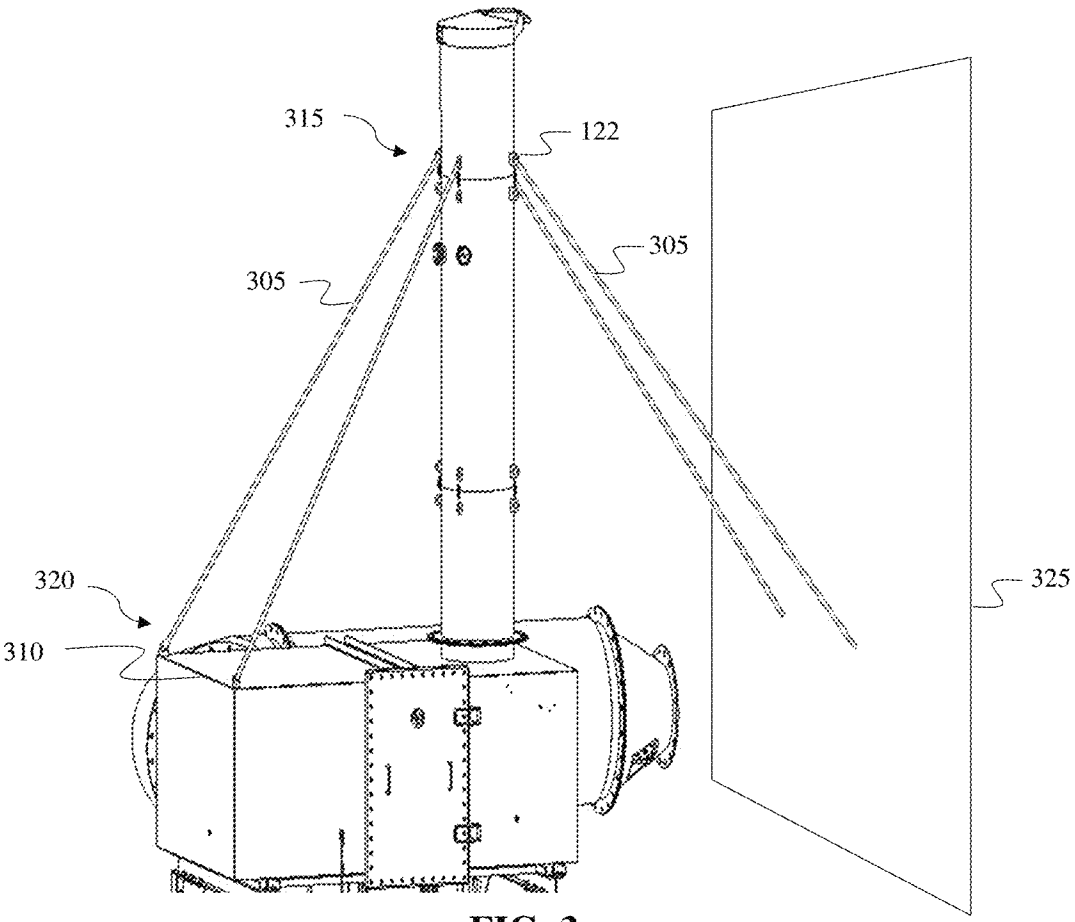
FIG. 3 is a perspective view of the fully assembled configuration of the system illustrating guy wires, tabs, and attached surfaces, according to an example embodiment.

Referring to FIG. 3, illustrated is a perspective view of the system in the fully assembled configuration. In one embodiment, the system further includes a guy wire 305 used to secure the system to a surface 310. The guy wire may include guy wires made from materials such as galvanized steel, copper, rope, stainless steel, fiberglass, ceramic, metal, and other materials with high tensile strength. The guy wire will attach to the surface which may include surfaces such as ground, generator enclosures, walls, roofs, buildings, metal, brick, concrete, wood, and other surfaces sufficient to support the system. Referring to FIG. 3, the system is shown with guy wires attached to two different surfaces 310 and 325, according to an example embodiment. Surface 310 is a generator enclosure which supports the exhaust stack and surface 325 is a wall. It is understood that surface 310 and surface 325 may be the same surface. It is understood that the system does not need to attach to multiple surfaces. The guy wire includes a guy wire first end 315 and a guy wire second end 320. The guy wire first end attaches to at least one of the tabs, either the first tabs or second tabs of the system. The guy wires attach to the exhaust stack by attaching to the tabs through the tab holes. The guy wire may attach to the tabs by means such as a hook, clasp, latch, stake, or the guy wire may be looped through the tab hole and secured back to the guy wire by a metal clasp, or other means of attaching guy wires. However, other fasteners may be used and are within the spirit and scope of the present invention. The guy wire second end attaches to at least one surface in a similar manner. The surface may include a tab for the guy wire to attach to, or the guy wire may attach directly to the surface. In one embodiment, two guy wires are attached to at least one tab on opposing sides of the exhaust pipe so that four guy wires attach to at least one surface. The attachment of the guy wires to the tabs may be adjusted depending on various factors, including height of the fully assembled system. The amount of guy wires may be increased or decreased depending on the various factors including height of the fully assembled configuration.

Figure 4:
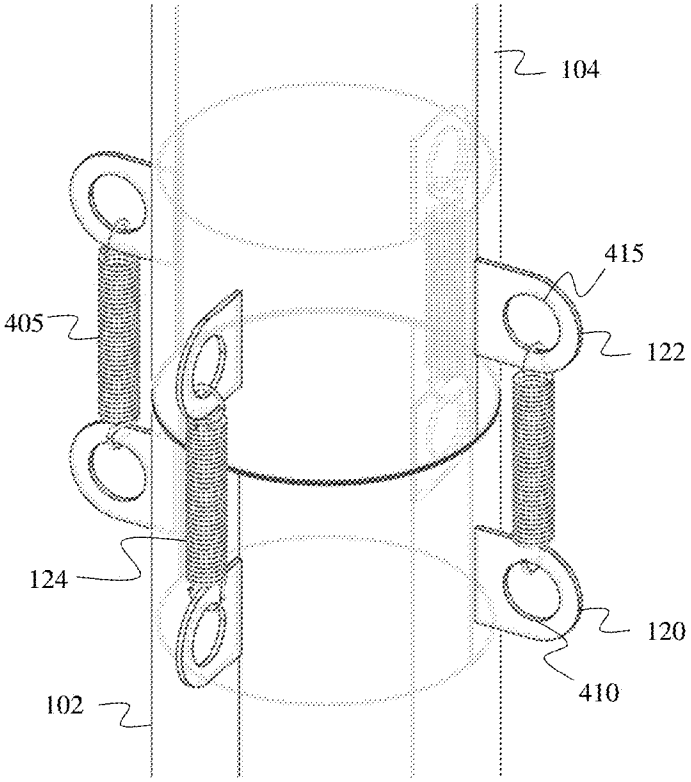
FIG. 4 is a detailed perspective view of the components of the system illustrating a first tabs including a first hole, a second tabs including a second hole, and fasteners including a biasing element illustrated as a spring, according to an example embodiment.

Referring to FIG. 4, illustrated is a detailed perspective view of the system depicting the fasteners and the tabs, according to an example embodiment. The first tabs 120 include a first hole 410 and the second tabs 122 include a second hole 415. In the assembled configuration, the tubular bodies of the system are attached to each other by inserting a male section 520 into a female section 540 further detailed in FIG. 5D. The male section can be viewed in FIG. 4 as depicted by the light black lines of the illustration. Once the male section of a tubular body is inserted into a female section of another tubular body, then the system needs to be secured using a fastener 124. The system includes a plurality of fasteners. The fasteners attach to the first tabs through the first hole and the second tab through the second hole. This secures the tubular bodies together. Referring to FIG. 4, the first tabs of the first tubular body 102 is attached to the second tabs of the second tubular body 104 using a plurality of fasteners. In one embodiment, the fasteners include a biasing element 405. The fasteners may include biasing elements such as springs, latches, wire, ties, cables, chain, links, gaskets, clamps, welds, and other fasteners. Other fasteners may also be used and are within the spirit and scope of the present invention. The fastener will connect to the first tabs and second tabs creating a tensile force within the fastener and a compression force between the tubular bodies at the intersection of the female end surface 545 of the female end section 540 and the shoulder 535 of the male section 520 as further detailed in FIG. 5D. The compression forces between the tubular bodies created by the fasteners will create a seal between the tubular bodies and attach the tubular bodies to lengthen the exhaust stack and prevent the premature evacuation of exhaust gasses. The length of the male section of each tubular shaped body may also depend on a variety of different factors including height of the fully assembled configuration, width of the tubular shaped body, wind loading calculations etc. It is understood that other factors may also be used to calculate the length of the male section. The outside diameter of the female section may be configured such that it is flush with the outside diameter of the section of the tubular shaped body below the male section when the system is in the fully assembled configuration.

Referring to FIG. 5A, illustrated is a perspective view of the first tubular body, according to one embodiment. The first tubular body includes a first body first end 108 and a first body second end 110. The first body defines a first length 505 measured from the first body first end to the first body second end. The first length may be adjusted based on variety of different parameters including height of the fully assembled configuration of the system, industry standards of pipe, manufacturing standards of pipe, standard widths of pipe and a variety of other measurements and factors. However, it understood that other factors may be used in determining the length of each tubular shaped body. The first tubular body includes a male section 521 on the first body second end. The male section is further detailed in FIG. 5D. The first tubular body also includes a female section 541 on the first body first end. The female section is further detailed in FIG. 5D. In one embodiment, the first body first end includes a flanged section 550. The flanged section allows the first tubular body to be attached to a surface 310. The dimension of the flanged section may be varied based on a variety of different parameters. The flanged section may include openings for allowing fasteners to attach the flanged section to the surfaces. It is understood that in some embodiments, the first tubular body may include an emission opening 205. The first tubular body further includes a first tabs 120 which may be used to secure guy wires and attach a plurality of fasteners. The male section of the first tubular body has an outside diameter smaller than the inside diameter of the female section of either the second tubular body or the third tubular body, depending on the embodiment. The male section of the first tubular body is configured to be inserted inside of the female end of either a third tubular body or a second tubular body.

Figure 5B:
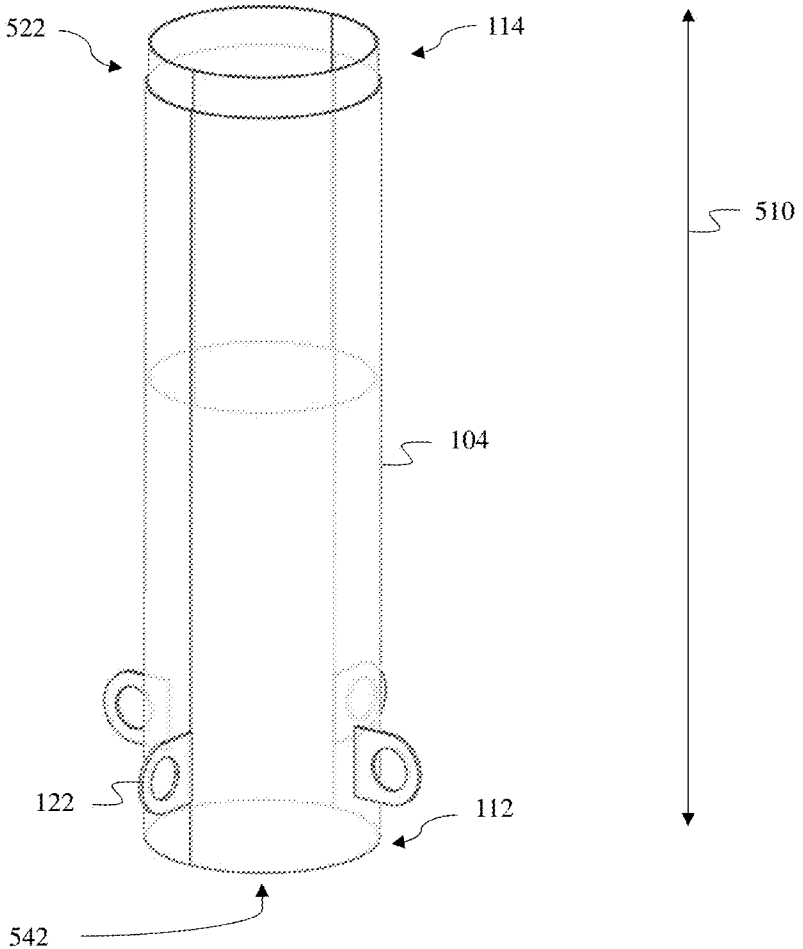
FIG. 5B is a detailed perspective view of a second tubular section, according to one embodiment.

Referring to FIG. 5B, illustrated is a perspective view of the second tubular body, according to one embodiment. The second tubular body includes a second body first end 112 and a second body second end 114. The second body defines a second length 510 measured from the second body first end to the second body second end. The second tubular body includes a male section 522 on the second body second end. The male section is further detailed in FIG. 5D. Similar to the male section pf the other tubular bodies, the length of male section 522 may be adjusted based on variety of different parameters including height of the fully assembled configuration of the system, industry standards of pipe, manufacturing standards of pipe, standard widths of pipe and a variety of other measurements and factors. However, it understood that other factors may be used in determining the length of each male section. The second tubular body also includes a female section 542 on the second body first end. The female section is further detailed in FIG. 5D. It is understood that in some embodiments, the second tubular body may include an emission opening 205. The second tubular body further includes a second tabs 120 which may be used to secure guy wires and attach a plurality of fasteners. The male section of the second tubular body has an outside diameter smaller than the inside diameter of the female section of either a cap, a second tubular body or a third tubular body, depending on the embodiment. The male section of the second tubular body is configured to be inserted inside of the female end of either a third tubular body or a second tubular body or it is configured to fit a cap. The female section of the second tubular body is configured to fit over a male section of either a first tubular body, a second tubular body, or a third tubular body. The inside diameter of the female section of the second tubular body is larger than the outside diameter of a male section of a first tubular body, a second tubular body, or a third tubular body, depending on the embodiment. The male and female ends are configured to allow a variety of different embodiments and lengths that allow users and operators to easily adjust the height of the fully assembled configurations.

Figure 5C:
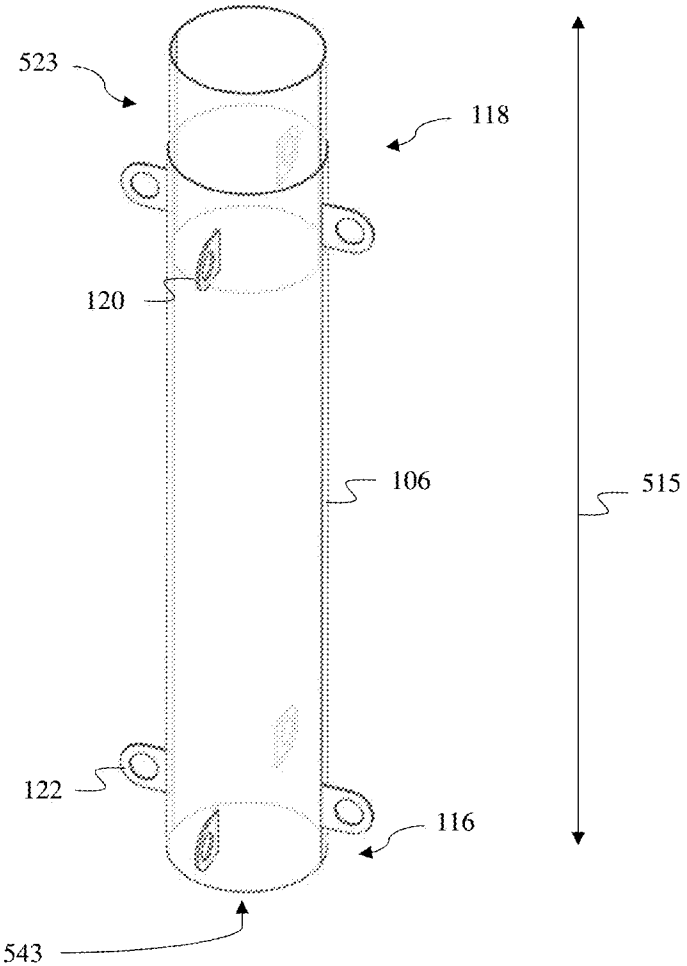
FIG. 5C is a detailed perspective view of a third tubular section, according to one embodiment.

Referring to FIG. 5C, illustrated is a perspective view of the third tubular body, according to one embodiment. The third tubular body includes a third body first end 116 and a third body second end 118. The third body defines a third length 515 measured from the third body first end to the third body second end. Length 515 of the third section may be adjusted based on variety of different parameters including height of the fully assembled configuration of the system, industry standards of pipe, manufacturing standards of pipe, standard widths of pipe and a variety of other measurements and factors. However, it understood that other factors may be used in determining the length of each male section. The third tubular body includes a male section 523 on the third body second end. The male section is further detailed in FIG. 5D. The third tubular body also includes a female section 543 on the third body first end. As with other tubular shaped bodies, the length of the male section 523 may be adjusted based on variety of different parameters including height of the fully assembled configuration of the system, industry standards of pipe, manufacturing standards of pipe, standard widths of pipe and a variety of other measurements and factors. However, it understood that other factors may be used in determining the length of male sections. The female section is further detailed in FIG. 5D. It is understood that in some embodiments, the third tubular body may include an emission opening 205. The third tubular body further includes a first tabs 120 and a second tabs 122 which may be used to secure guy wires and attach a plurality of fasteners. The male section of the third tubular body has an outside diameter smaller than the inside diameter of the female section of either a second tubular body or a third tubular body, depending on the embodiment. The male section of the third tubular body is configured to be inserted inside of the female end of either a third tubular body or a second tubular body. The female section of the third tubular body is configured to fit over a male section of either a first tubular body, a second tubular body, or a third tubular body. The inside diameter of the female section of the third tubular body is larger than the outside diameter of a male section of a first tubular body, a second tubular body, or a third tubular body, depending on the embodiment.

Figure 5D:
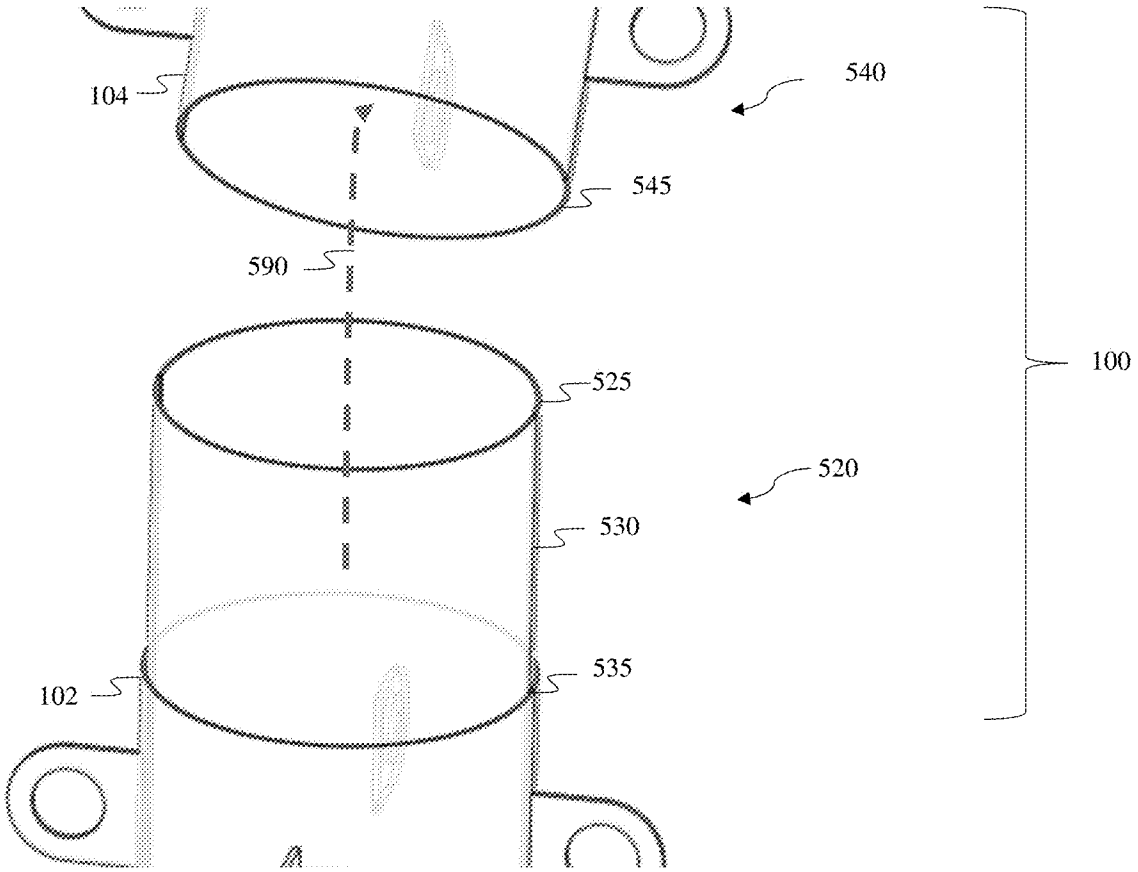
FIG. 5D is a detailed, partially exploded perspective view of the system illustrating a male section and a female section of the tubular bodies, according to an example embodiment.

It is understood that the male section 521 of the first tubular body, male section 522 of the second tubular body, and male section 523 of the third tubular body may include the same dimensions as illustrated by male section 520 of FIG. 5D, according to one embodiment. It is further understood that the female section 541 of the first tubular body, female section 542 of the second tubular body, and the female section 543 of the third tubular body may include the same dimensions as illustrated by female section 540 of FIG. 5D, according to one embodiment. However, it is understood that other lengths may be used and are within the spirit and scope of the present invention. Additionally, it is understood that where the first tubular body defines a first length, each second tubular body defines a second length, the third tubular body defines a third length at least one of first length, second length and third length are not equidistant.

Referring to FIG. 5D, illustrated is a detailed perspective view of the system depicting the male section 520 and female section 540 of the tubular bodies, according to one embodiment. The male section includes a male end surface 525, a sleeve wall 530, and a shoulder 535. The male section is configured to be inserted into the female section of the adjacent tubular body so that the male end surface abuts the adjacent tubular body's female end surface. The female section 540 includes a female end surface 545, where the sleeve wall of the male section has an outside diameter less than an internal diameter of the female section. Because the male section has a smaller outside diameter than the inside diameter of the female section, the male section is configured to fit inside of the female section so that the outward facing surface of the female section is flush with the outward facing surface of the section of pipe below the male section. The female end surface will rest upon the shoulder of the adjacent tubular body when the male section is fully inserted into the female section. The dotted arrow 590 illustrates connecting the second tubular shaped body first end to the first tubular shaped body second end by inserting a male portion of at least one of the first tubular shaped body and second tubular shaped body into a female portion of at least one of the first tubular shaped body and second tubular shaped body. The female section may further include rivets, threading, rubber, and other mechanisms consistent with present technology used to interlock parts and create a seal. Such rivets and threading may be able to prevent torsional bending and increase wind load resistance.

Figure 6:
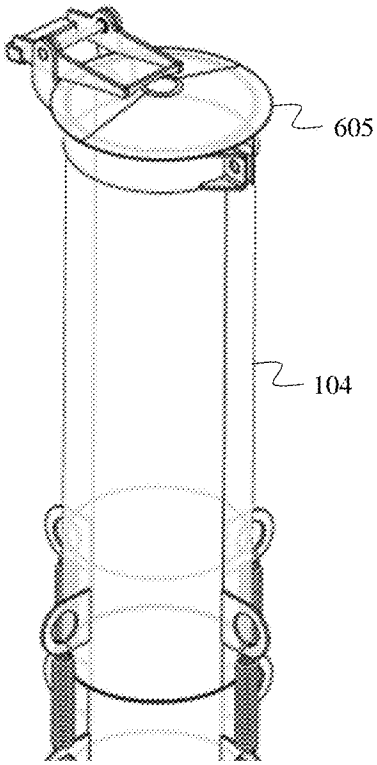
FIG. 6 is a perspective view of the components of the system illustrating a cap attached to the second tubular body, according to an example embodiment.

Referring to FIG. 6, illustrated is detailed perspective view of the system depicting a cap 605 attached to the second tubular body, according to an example embodiment. It is understood that the fully assembled configuration of the system may include a cap attached to a second end of a tubular body. The cap may be attached to the system by methods such as hinges, force fit, screws, and other methods consistent with present technology and within the spirit and scope of this disclosure. According to one embodiment, the cap may include features such as emission openings to allow the emission gasses to escape the system while preventing the surrounding elements of the environment from entering the system, such as rain. In another embodiment, the cap may include hinges which allow the cap to lift up due to the pressure buildup of the exhaust gasses within the system. When the cap is lifted the exhaust gasses will evacuate the system. In other embodiments, the cap may include any exhaust caps consistent with present technology in the field. It is understood that the cap may be attached to either a first tubular body, a second tubular body, or a third tubular body consistent with the spirit and scope of the disclosure.

Figure 7:
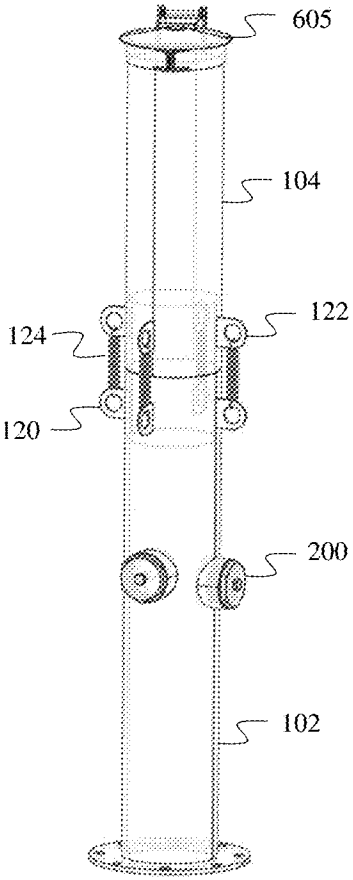
FIG. 7 is a perspective view of the system including a first tubular body and a second tubular body, according to one embodiment.

Referring to FIG. 7, illustrated is an example embodiment of the system in a fully assembled configuration including only a first tubular body and a second tubular body. It is understood that the system may not include a third tubular body in some embodiments. The system still includes a plurality of fasteners, first tabs, second tabs, a first tubular body with a first end and a second end, and a second tubular body with a first end and a second end. Each of the first tubular body and the second tubular body include a female section and a male section were the first tubular body is connected to the second tubular body and secured by a fastener. The attachment between the male section inside of the female section is depicted by the light black lines illustrating the hidden features of the embodiment.

Figure 8:
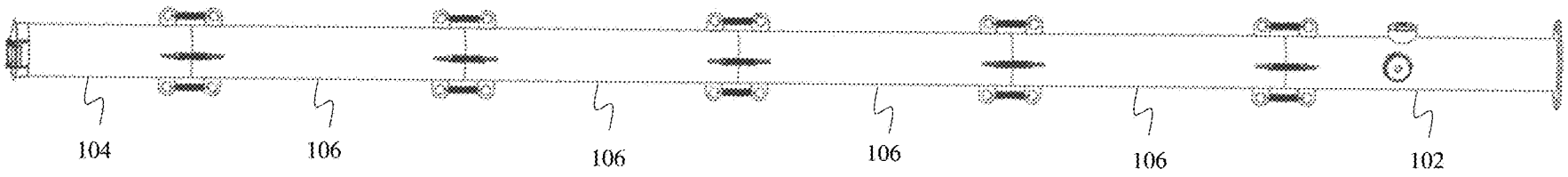
FIG. 8 is a perspective view of the system including a first tubular body, a second tubular body, and a plurality of third tubular bodies, according to an example embodiment.

Referring to FIG. 8, illustrated is an example embodiment of the system in a fully assembled configuration including a first tubular body, a second tubular body, and a plurality of third tubular bodies. It is understood that the system may include a plurality of third tubular body in some embodiments. The system still includes a plurality of fasteners, first tabs, second tabs, a first tubular body with a first end and a second end, and a second tubular body with a first end and a second end. Each of the first tubular body and the second tubular body include a female section and a male section where the tubular bodies connect to each other and are secured by a fastener. FIGS. 7 and 8 illustrate that the system may be easily modified to change the length of the fully assembled configuration be adding or removing third tubular shaped bodies.

Figure 9:
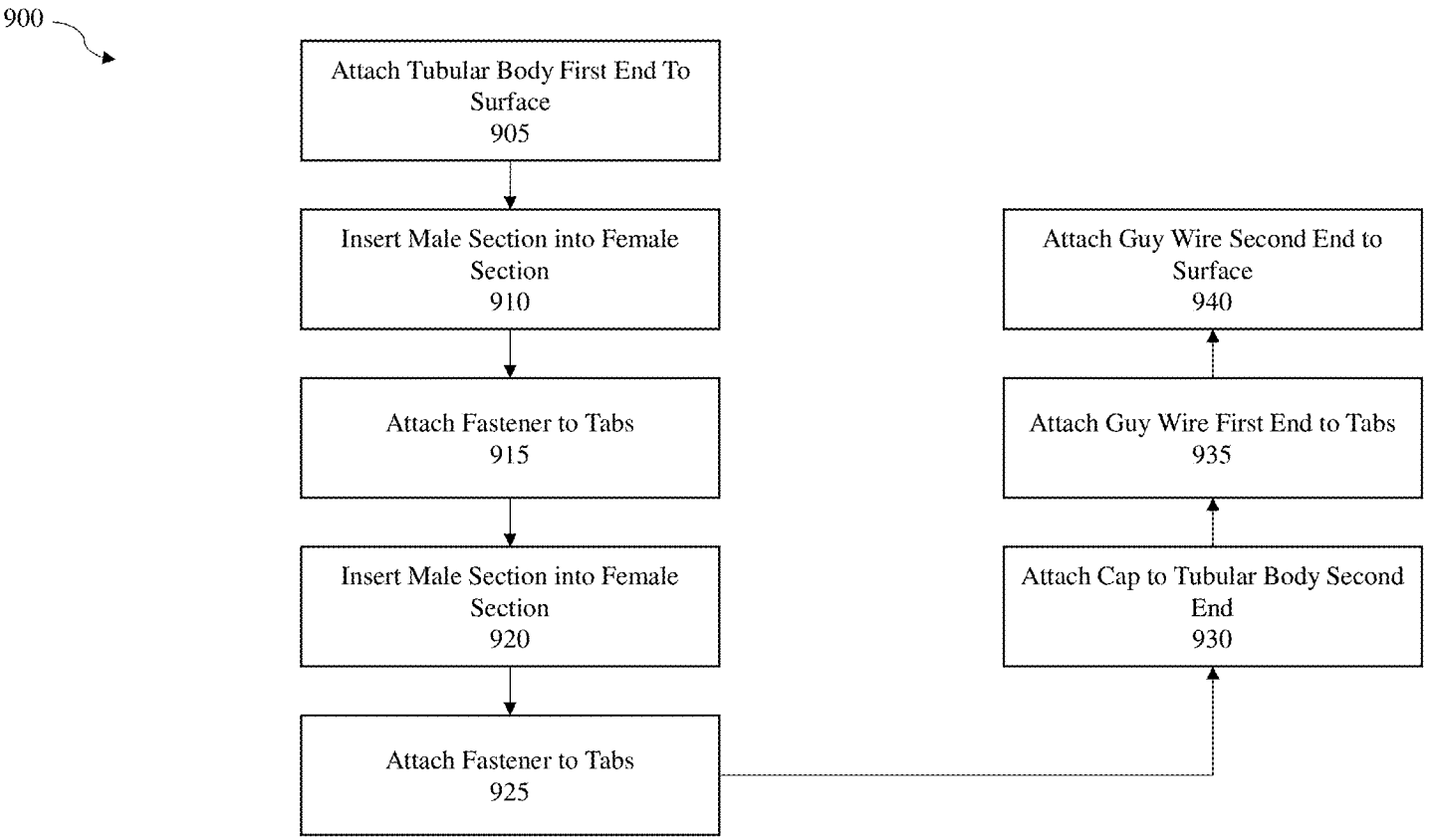
FIG. 9 is a block diagram of a method of connecting the tubular bodies comprising inserting the male section into the female section, according to one embodiment.

Referring to FIG. 9, illustrated is a block diagram depicting a method 900 of connection between tubular bodies to assemble the system into the fully assembled configuration, according to one embodiment. The method of assembling the system into the fully assembled configuration includes a step 905 where a tubular body first end is attached to a surface 310. According to one embodiment, the flanged section on the first body first end of the of the first tubular body will attach to a surface. In operation a user may use fasteners that pass though openings on the flanged section to attach the first tubular shaped body to the surface 310. The male section on the first body second end of the first tubular body is inserted 910 into the female section on the third body first end of the third tubular body. Once the first body is inserted to the second body, fasteners are attached 915 to first tabs of the first tubular body and second tabs of the third tubular body to secure the connection between the first tubular body and the third tubular body. Then, the male section on the third body second end of the third tubular body is inserted 920 into the female section on the second body first end of the second tubular body. It is understood that in other embodiments, there may be multiple subsequent iterations of steps 910 and 915. It is also understood that in some embodiments, steps 910 and 915 may be omitted. Once the third body is inserted to the second body, fasteners are attached 925 to first tabs of the third tubular body and second tabs of the second tubular body to secure the connection between the third tubular body and the second tubular body. In some embodiments, a cap is then attached 930 to the second body second end of the second tubular body. To support the system, guy wires are then attached. The guy wire first ends are attached 935 to the tabs on the system. The guy wire second ends are attached 940 to a surface. It is understood that the attached surface in step 905 may be the same attached surface in step 940, or the surfaces may be different and include multiple surfaces of attachment.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A modular and transportable tubular exhaust system that is attached to a generator comprising:

a first tubular body, a second tubular body and at least one third tubular body connecting to form, in a fully assembled configuration, a vertically arranged exhaust pipe;

the first tubular body comprises a first tubular body first end and a first tubular body second end;

the second tubular body comprises a second tubular body first end and a second tubular body second end;

the at least one third tubular body having a third tubular body first end and a third tubular body second end;

where said first ends and second ends are configured to mate with each other to form the vertically arranged exhaust pipe;

a pair of first tabs extending radially outward, relative to the longitudinal axis of the vertically arranged exhaust pipe, and from the first tubular body second end;

a second pair of first tabs extending from the third tubular body second end;

and where the pair of first tabs are on opposing sides of the first tubular body and each second pair of first tabs are on opposing sides each third tubular body;

a pair of second tabs extending radially outward from each of the third tubular body first end and the second tubular body first end, where the second tabs are on opposing sides of third tubular body and second tubular body;

wherein the first tabs on the first tubular body and the second tabs on the third tubular body are separated apart from each other defining a gap;

a plurality of fasteners, where each fastener attaches one first tab with one second tab on a same side of adjacent tubular bodies when the vertically arranged exhaust pipe is in the fully assembled configuration.

2. The system of claim 1, where at least one of the first tubular body, second tubular body and third tubular body have an emission opening providing access to inside the exhaust pipe so that a sample of emissions flowing through the system may be collected.

3. The system of claim 2, where the emission opening is defined by a threaded emission opening wall, and where a threaded plug is removably attached to the threaded emission opening wall.

4. The system of claim 3, where a first guy wire first end is in attachment with at least one of the pair of second tabs on the second tubular body at an upper part of the system and a first guy wire second end of the first guy wire is attachment with the generator at a lower part of the system.

5. The system of claim 4, further comprising:

a second guy wire in attachment with a second tab of the pair of second tabs of the second tubular body at the upper part of the system on an opposite side of the vertically arranged exhaust pipe; and and a second guy wire second end is in attachment with the generator at the lower part of the system.

6. The system of claim 5, where each fastener comprises a biasing element.

7. The system of claim 6, where the biasing element is a spring.

8. The system of claim 7, where the first tubular body defines a first length, the second tubular body defines a second length, the at least one third tubular body defines a third length, and where at least two of the first length, second length and third length are not substantially the same length.

9. The system of claim 8, where a cap is attached to the second tubular body second end.

10. The system of claim 9, where the first tubular body first end comprises a flanged section.

11. The system of claim 10, where each of the first tubular body, second tubular body and third tubular body further define:

male section having a male end surface, a sleeve wall and a shoulder;

a female section having a female end surface, where the sleeve wall of the male section has an outside diameter less than an internal diameter of the female section; and where the male section is configured be inserted into the female section of the adjacent tubular body so that the male end surface abuts the adjacent tubular body's female end surface.

12. A modular tubular exhaust system comprising:

a first tubular body and a second tubular body connecting to form, in a fully assembled configuration, an exhaust pipe;

the first tubular body comprises a first tubular body first end and a first tubular body second end;

the second tubular body comprises a second tubular body first end and a second tubular body second end;

where the first tubular body and second tubular body each comprise a male section and a female section;

where the male section has a male end surface, a sleeve wall and a shoulder;

where the female section has a female end surface;

where the sleeve wall of the male section has an outside diameter less than an internal diameter of the female section;

where the male section is configured be inserted into the female section of the adjacent tubular body so that the male end surface abuts the adjacent tubular body's female end surface;

a pair of first tabs extending radially outward from the second end of the first tubular body;

a pair of second tabs extending radially outward from the second tubular body first end;

wherein the first tabs on the first tubular body and the second tabs on the second tubular body are separated apart from each other defining a gap; and, a plurality of fasteners, where each fastener attaches one first tab with one second tab when the vertically arranged exhaust pipe is in the fully assembled configuration.

13. The system of claim 12, where the at least one of the first tubular body or second tubular body has an emission opening providing access to inside the exhaust pipe so that a sample of emissions flowing through the system may be collected.

14. The system of claim 13, where the emission opening is defined by a threaded emission opening wall, and where a threaded plug is removably attached to the threaded emission opening wall.

15. The system of claim 12, where a guy wire first end of at least one guy wire is in attachment with at least one of the second tabs on an upper end of the system and a guy wire second end of the guy wire attaches to at least one surface to which the exhaust pipe is attached.

16. The system of claim 12, where the first tubular body first end comprises a flanged section.

17. The system of claim 12, where a third tubular body is positioned between the first tubular body and the second tubular body.

18. A modular and transportable tubular exhaust system comprising:

a first tubular body and a second tubular body connecting to form, in a fully assembled configuration, an exhaust pipe;

the first tubular body comprises a first tubular body first end and a first tubular body second end;

the second tubular body comprises a second tubular body first end and a second tubular body second end;

a pair of first tabs extending radially outward from the second end of the first tubular body;

a pair of second tabs extending radially outward from the second tubular body first end;

wherein the first tabs on the first tubular body and the second tabs on the second tubular body are separated apart from each other defining a gap; and, a plurality of fasteners, where each fastener comprises a biasing element that attaches one first tab with one second tab when the vertically arranged exhaust pipe is in the fully assembled configuration;

wherein each biasing element comprises a spring.

19. The system of claim 18, where a guy wire first end of at least one guy wire is in attachment with at least one of the second tabs on an upper end of the system and a guy wire second end of same guy wire attaches to at least one surface to which the exhaust pipe is attached.

* * * * *